US011007415B2

(12) United States Patent
Onuki et al.

(10) Patent No.: US 11,007,415 B2
(45) Date of Patent: May 18, 2021

(54) GOLF CLUB HAVING SENSOR UNIT

(71) Applicant: Sumitomo Rubber Industries, Ltd., Hyogo (JP)

(72) Inventors: Masahide Onuki, Kobe (JP); Masahiko Ueda, Kobe (JP); Kousuke Okazaki, Kobe (JP); Yuto Nakamura, Kobe (JP); Yuki Nagano, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 84 days.

(21) Appl. No.: 16/382,624

(22) Filed: Apr. 12, 2019

(65) Prior Publication Data

US 2019/0314703 A1 Oct. 17, 2019

(30) Foreign Application Priority Data

Apr. 16, 2018 (JP) ..... JP2018-078365

(51) Int. Cl.
*A63B 69/36* (2006.01)

(52) U.S. Cl.
CPC ..... *A63B 69/3632* (2013.01); *A63B 2220/30* (2013.01); *A63B 2220/40* (2013.01); *A63B 2220/51* (2013.01); *A63B 2220/833* (2013.01)

(58) Field of Classification Search
None
See application file for complete search history.

(56) References Cited

U.S. PATENT DOCUMENTS 5,883,569 A * 3/1999 Kolefas ..... A63B 24/0021 340/384.1
2005/0215340 A1 9/2005 Stites et al.
2013/0095939 A1* 4/2013 Meadows ..... A63B 71/0619 473/222
2016/0271480 A1* 9/2016 Fukasawa ..... A63B 71/06
2016/0303443 A1* 10/2016 Boggs ..... A61B 5/1122

FOREIGN PATENT DOCUMENTS

JP 2007-530151 A 11/2007

* cited by examiner

*Primary Examiner* — James S. McClellan
*Assistant Examiner* — Peter J Iannuzzi
(74) *Attorney, Agent, or Firm* — Studebaker & Brackett PC

(57) ABSTRACT

Provided is a sensitive golf club with a sensor unit. The sensor unit includes a battery, a sensor module configured to measure sensor data indicating a state of the golf club using power from the battery, a communications unit configured to wirelessly transmit the sensor data to an external device using power from the battery, and a control unit configured to control operation of the sensor module and the communications unit using power from the battery. The sensor unit has an A mode, and a B mode in which operation of the communications unit is suppressed compared to the A mode. The control unit is configured to judge whether or not the golf club is prepared for a shot based on the sensor data, and switch between the A mode and B mode based on whether or not the golf club is prepared for a shot.

20 Claims, 13 Drawing Sheets

GOLF CLUB HAVING SENSOR UNIT

CROSS REFERENCE TO RELATED APPLICATION

This application claims a priority to Japanese Patent Application No. 2018-78365 filed on Apr. 16, 2018, which is hereby incorporated by reference in its entirety.

FIELD OF INVENTION

The present invention relates to a sensitive golf club, a sensor unit included in the sensitive golf club, a golf measurement system including the sensitive golf club, and a golf measurement program and method.

BACKGROUND

Conventionally, there is known a system that records a shot of a golfer by using a golf club with a sensor unit in which there is mounted a sensor module such as an acceleration sensor or an angular velocity sensor (see JP 2007-530151A of Patent Document 1). In Patent Document 1, the measurement data from the sensor module is wirelessly transmitted to an external portable computer through a communications module mounted in the same sensor unit. In this system, it is possible to collect shot measurement data in real time during a round on a golf course, and provide analysis results based on the measurement data to the golfer in real time.

SUMMARY OF THE INVENTION

However, if the sensor module is constantly performing measurement, a battery of the sensor unit quickly runs out. Also, if the communications module of the sensor unit and the external portable computer are constantly communicating, consumption of the battery is accelerated even more. Therefore, it is often difficult to record measurement data of all shots made by the golfer during a round of golf that lasts a long time. On the other hand, even though the round of golf lasts a long time, the period for which measurement data is desired is limited to when a shot is performed or the like. Therefore, with conventional technology, in order to conserve the battery, the golfer switches the sensor unit of the golf club on/off each time a shot is performed in a round. However, with this scheme, the golfer must be aware of the power on/off operation at all times during the round, and if the golfer forgets to switch on the power, recording of the shot at that time will be missed.

An object of the present invention is to provide a sensitive golf club capable of collecting recording of shots over a long period of time even if a golfer is unaware, a sensor unit included in the sensitive golf club, a golf measurement system including the sensitive golf club, and a golf measurement program and method.

A sensitive golf club according to a first aspect is provided with a golf club, and a sensor unit attached to the golf club. The sensor unit includes a battery; a sensor module that receives power supply from the battery, and measures sensor data that indicates a state of the golf club; a communications unit that receives power supply from the battery, and wirelessly transmits the sensor data to an external device; and a control unit that receives power supply from the battery, and controls operation of the sensor module and the communications unit. The sensor unit has an A mode, and a B mode in which operation of the communications unit is suppressed compared to the A mode. The control unit judges whether or not the golf club is prepared for a shot based on the sensor data, and executes processing of at least one of below (1) and (2).

(1) Processing where, in the B mode, when judged that the golf club is prepared for a shot, the sensor unit is switched to the A mode, and when judged that the golf club is not prepared for a shot, the sensor unit is not switched to the A mode (2) Processing where, in the A mode, when judged that the golf club is not prepared for a shot, the sensor unit is switched to the B mode, and when judged that the golf club is prepared for a shot, the sensor unit is not switched to the B mode A sensitive golf club according to a second aspect is provided with a golf club, and a sensor unit attached to the golf club. The sensor unit includes a battery; a sensor module that receives power supply from the battery, and measures sensor data that indicates a state of the golf club; and a control unit that receives power supply from the battery, and controls operation of the sensor module. The sensor unit has an A mode, and a B mode in which operation of the sensor module is suppressed compared to the A mode. The control unit judges whether or not the golf club is prepared for a shot based on the sensor data, and executes processing of at least one of below (1) and (2).

(1) being processing where, in the B mode, when judged that the golf club is prepared for a shot, the sensor unit is switched to the A mode, and when judged that the golf club is not prepared for a shot, the sensor unit is not switched to the A mode (2) being processing where, in the A mode, when judged that the golf club is not prepared for a shot, the sensor unit is switched to the B mode, and when judged that the golf club is prepared for a shot, the sensor unit is not switched to the B mode A golf measurement system according to a third aspect includes a golf club used by a golfer and to which a first sensor unit is attached, and an accessory carried by the golfer and to which a second sensor unit is attached. The first sensor unit includes a first sensor module that measures first sensor data, a first communications unit that performs wireless communications with an external device, and a first control unit that controls operation of the first sensor module and the first communications unit. The second sensor unit includes a second sensor module that measures second sensor data, a second communications unit that performs wireless communications with an external device, and a second control unit that controls operation of the second sensor module and the second communications unit. The first control unit judges a timing when the golfer performs a shot based on the first sensor data, and outputs timing data through the first communications unit based on the timing. The second control unit receives the timing data through the second communications unit, and causes the second sensor module to measure the second sensor data based on the timing data.

According to the first aspect and the second aspect, there is provided a sensor unit having a sensor module attached to a golf club and capable of measuring a state of the golf club. This sensor unit further has a control unit. Based on sensor data measured by the sensor module, this control unit judges whether or not the golf club is prepared for a shot, and according to the result of this judgment, the sensor unit is switched between the A mode and the B mode, in which there are different degrees of battery power consumption in the sensor unit. Thus, it is possible to conserve the battery without the golfer doing anything in particular. For the above reasons, it is possible to collect recording of shots over a long period of time even if the golfer is unaware. Such a power saving sensor unit is compatible with a round on a golf course over a long period of time.

According to the third aspect, there are provided a golf club to which a first sensor unit having a first sensor module is attached, and an accessory carried by the golfer and to which a second sensor unit is attached. The control unit of the first sensor unit judges a timing when the golfer performs a shot based on the first sensor data measured by the first sensor module, and wirelessly outputs timing data through the first communications unit. On the other hand, the control unit of the second sensor unit wirelessly receives the timing data through the second communications unit, and causes the second sensor module to measure the second sensor data based on the timing data. Therefore, it is possible to collect necessary information at a necessary time in the second sensor unit even if the golfer is unaware.

DETAILED DESCRIPTION OF THE PREFERRED EMBODIMENTS

A sensitive golf club according to one embodiment of the present invention, a sensor unit included in the sensitive golf club, a golf measurement system including the sensitive golf club, and a golf measurement program and method, will be described below with reference to the drawings.

1. Overall Configuration of Golf Measurement System

Figure 1:
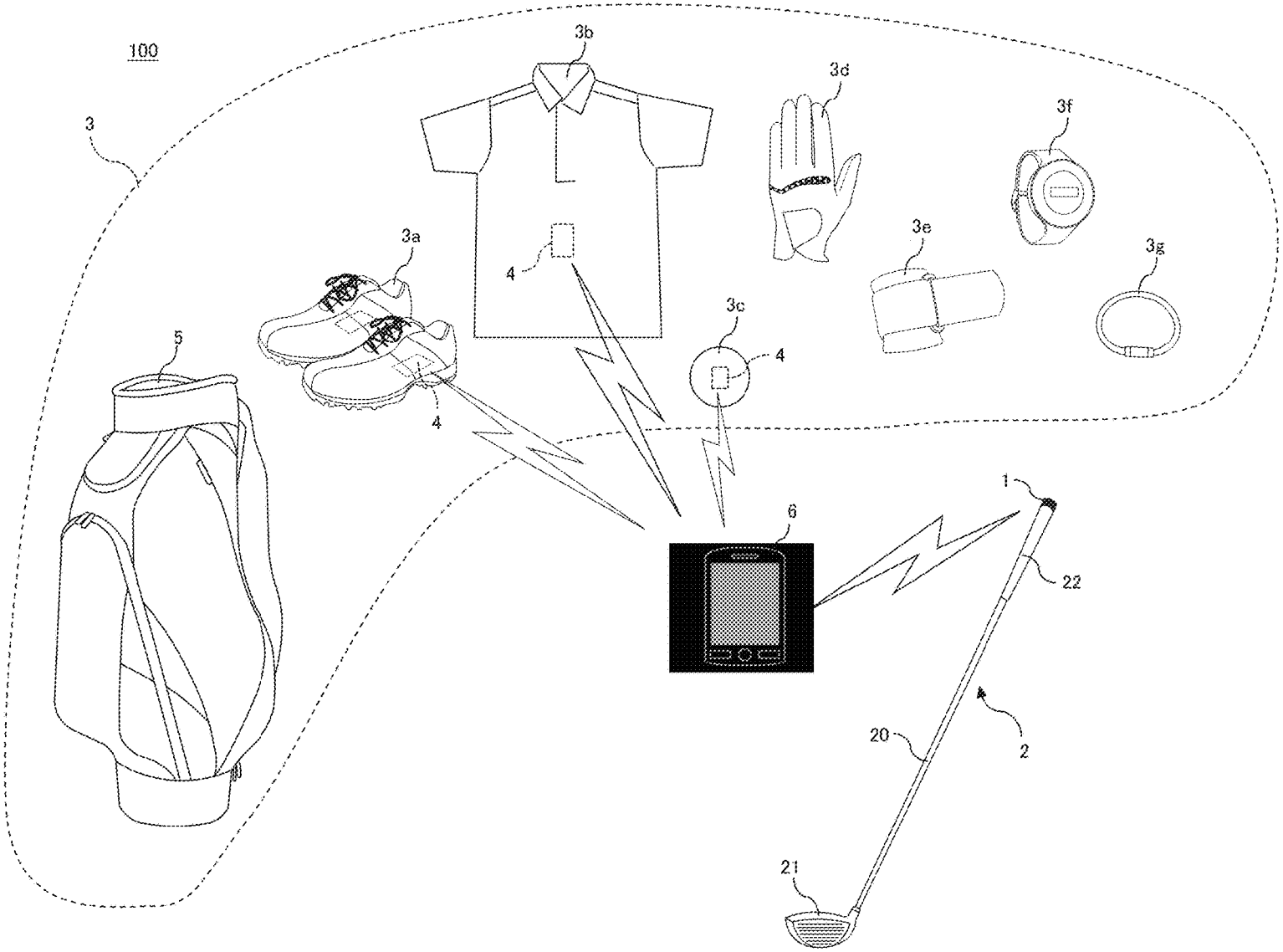
FIG. 1 shows the configuration of a golf measurement system including a golf club with a sensor unit according to one embodiment of the present invention.

FIG. 1 shows an overall configuration diagram of a golf measurement system 100 according to the present embodiment. The golf measurement system 100 is a system that collects data related to shots (hereinafter referred to as shot data) performed by a golfer and analyzes this data. The shot data is not limited to this, but is typically collected during a round on a golf course. The golf measurement system 100 includes a golf club 2 with a sensor unit 1, various accessories 3, and a mobile terminal 6. The golf club 2 and the various accessories 3 are carried on the golf course by the golfer, and carried and used during a round. The mobile terminal 6 is likewise carried on the golf course by the golfer and is carried during the round.

The accessories 3 include golf equipment such as a caddy bag 5, shoes 3*a*, clothing 3*b*, a ball 3*c*, a glove 3*d*, and a supporter 3*e*, as well as non-golf equipment such as a wristwatch 3*f* and bracelet 3*g*. Note that the wristwatch 3*f* and the bracelet 3*g* may also be golf equipment configured to be suitable for use in golf. In the present embodiment, a sensor unit 4 is attached to each of the shoes 3*a*, the clothing 3*b*, and the ball 3*c*.

The sensor unit 1 attached to the golf club 2 collects various sensor data including shot data indicating the state of the golf club 2 at the time of shots, and wirelessly transmits this data to an external device. The external device mentioned here includes the mobile terminal 6. For some of the accessories 3, in the present embodiment, the sensor units 4 attached to the shoes 3*a*, the clothing 3*b*, and the ball 3*c* also collect various sensor data and wirelessly transmit this data to an external device. The external device mentioned here also includes the mobile terminal 6.

Various sensor data collected as described above is used for shot analysis by the mobile terminal 6. The result of this analysis is provided to the golfer through the mobile terminal 6 as appropriate. The golfer can make use of the results of this analysis in play during the current round or in future play.

Below, after describing the configurations of the golf club 2 with the sensor unit 1, the various accessories 3, and the mobile terminal 6, various processing executed by the golf measurement system 100 will be described.

2. Configuration of Components

2-1. Golf Club With Sensor Unit

As shown in FIG. 1, the golf club 2 is an ordinary golf club, and has a shaft 20, a head 21 provided at one end of the shaft 20, and a grip 22 provided at the other end of the shaft 20. The sensor unit 1 that measures sensor data indicating the state of the golf club 2 is attached to the golf club 2. The sensor unit 1 is configured to be compact and lightweight so as to not hinder the play of the golfer, and in the present embodiment, the sensor unit 1 is not detachable from the golf club 2, but the sensor unit 1 can also be configured to be detachable from the golf club 2.

Figure 2:
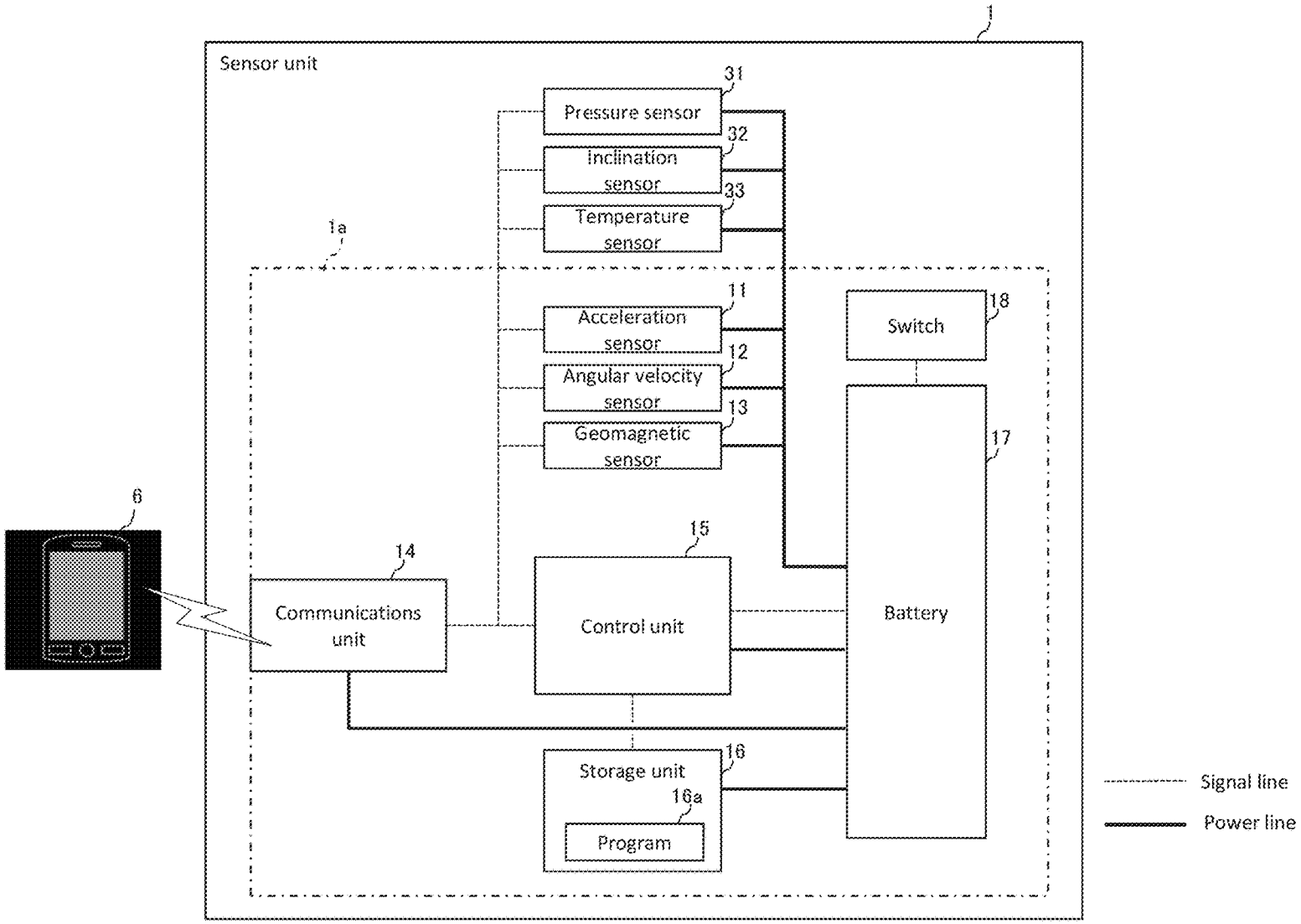
FIG. 2 is a block diagram showing the configuration of the sensor unit attached to the golf club.

As shown in FIG. 2, an acceleration sensor 11, an angular velocity sensor 12, and a geomagnetic sensor 13 are mounted in the sensor unit 1. The acceleration sensor 11 is a triaxial acceleration sensor module that measures accelerations $a_x$, $a_y$, and $a_z$ in the x axis, y axis, and z axis directions in an xyz local coordinate system. The angular velocity sensor 12 is a triaxial angular velocity sensor module that measures angular velocities $\omega_x$, $\omega_y$, and $\omega_z$ around the x axis, the y axis, and the z axis. The geomagnetic sensor 13 is a triaxial geomagnetic sensor module that measures geomagnetism $m_x$, $m_y$, and $m_z$ in the x axis, y axis, and z axis directions.

In the sensor unit 1, in addition to the sensor modules 11 to 13, a communications unit 14, a control unit 15, a storage unit 16, and a battery 17 are mounted. The communications unit 14 is compliant with the standards of non-contact communications such as Wi-Fi (registered trademark) or Bluetooth (registered trademark) or near-field wireless communications, and enables wireless communications with an external device that is similarly compliant with these standards. The communications unit 14 operates by receiving power supply from the battery 17, and from among the sensor data measured by the sensor modules 11 to 13, wirelessly transmits shot data indicating the state of the golf club 2 at the time of a shot to an external device such as the mobile terminal 6. Note that the shot data can include not only sensor data during a shot period, but also sensor data collected during a period in which there is a possibility of a shot being performed, including sensor data before and after the sensor data during a shot period.

The control unit 15 is configured with a CPU, a ROM, a RAM, and the like. The control unit 15 operates by receiving power supply from the battery 17, and controls operation of the sensor modules 11 to 13, the communications unit 14, the storage unit 16, and the battery 17. The storage unit 16 is configured with a storage device such as a nonvolatile rewritable flash memory or the like, and receives power supply from the battery 17 to store and erase data. A program 16*a* is stored in the storage unit 16, and the CPU of the control unit 15 reads out and executes the program 16*a*, thereby executing operations described later. Note that the program 16*a* may be stored not in the storage unit 16, but in the ROM of the control unit 15, or the program 16*a* may be stored distributed in both the storage unit 16 and the control unit 15.

The battery 17 is a power source that supplies power to the sensor modules 11 to 13, the communications unit 14, the control unit 15, and the storage unit 16, and the battery 17 is controlled on/off by the control unit 15. Also, the sensor unit 1 has a switch 18 accessible from outside the golf club 2, and the battery 17 is switched on/off also by the golfer operating this switch 18. The battery 17 may be a storage battery or a dry battery, and in the present embodiment the battery 17 is rechargeable.

The above sensor modules 11 to 13, the communications unit 14, the control unit 15, the storage unit 16, and the battery 17 are mounted on one or a plurality of substrates and constitute an inertial sensor unit 1*a*. The installation position of the inertial sensor unit 1*a* is not particularly limited, but in the present embodiment, the inertial sensor unit 1*a* is installed in the grip 22 at the end on the opposite side as the head 21.

A pressure sensor 31, an inclination sensor 32, and a temperature sensor 33 are also mounted in the sensor unit 1. The pressure sensor 31 is attached to the inside of the grip 22, and is a sensor module that measures the pressure when the golfer grips the grip 22. The inclination sensor 32 is also referred to as a level sensor, and is a sensor module that detects the horizontal direction, and measures the orientation of the longitudinal direction of the shaft 20 relative to this horizontal direction or a reference direction based on the horizontal direction, that is, the orientation of the golf club 2.

The installation position of the inclination sensor 32 is not particularly limited, but is, for example, inside the shaft 20. The temperature sensor 33 is a sensor module that measures the temperature of the surrounding environment. The installation position of the temperature sensor 33 is not particularly limited, but is, for example, inside the shaft 20.

Not only the sensor modules 11 to 13, but also the sensor modules 31 to 33, are connected to the control unit 15 and the battery 17. Therefore, the sensor modules 31 to 33 also operate by receiving power supply from the battery 17, and their operation is controlled by the control unit 15. The control unit 15 executes various processing to be described later based on the sensor data detected by the sensor modules 11 to 13 and 31 to 33.

2-2. Accessories

2-2-1. Caddy Bag

Figure 3:
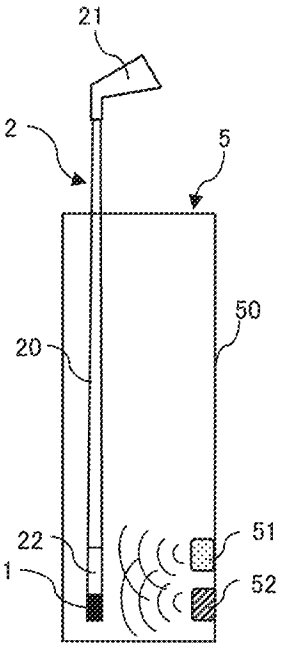
FIG. 3 shows the configuration of a caddy bag.

The caddy bag 5 is a bag for storing the golf club 2 with the sensor unit 1. The caddy bag 5, as shown in FIG. 3, in addition to a bag body 50 that is an ordinary caddy bag, has a charger 51 and a magnetic source 52 that are attached to the bag body 50.

Usually, the golf club 2 with the sensor unit 1 is stored in the bag body 50 in a state with the head 21 up and the grip 22 pointing down. When the golf club 2 is stored in the bag body 50 in such a state, the charger 51 and the magnetic source 52 are provided within the bag body 50 so as to be located near the battery 17 and the geomagnetic sensor 13 respectively included in the sensor unit 1 (typically near the bottom of the bag body 50).

The charger 51 is a device that charges the battery 17, and in the present embodiment, wireless charging is possible. The battery 17 is charged while the charger 51 is connected to another power source not shown through a power cord or the like and the golf club 2 is stored in the bag body 50. For example, the battery 17 can be charged from a household outlet before going to the golf course. Note that, if the charger 51 is a storage-type charger for example, the battery 17 can be charged even when the charger 51 is not connected to a power source.

The magnetic source 52 is a magnetism generating source, and can be constituted from, for example, a permanent magnet. The magnetism generated from the magnetic source 52 is detected by the geomagnetic sensor 13 when the golf club 2 is being stored in the bag body 50. Therefore, the control unit 15 of the sensor unit 1 can judge whether or not the golf club 2 is stored in the caddy bag 5 based on the magnetism detected by the geomagnetic sensor 13. Note that a geomagnetic sensor is one type of magnetic sensor, and is a sensor that detects very small magnetism like geomagnetism. Instead of or in addition to such a geomagnetic sensor 13, it is also possible to attach a magnetic sensor that detects larger magnetism to the golf club 2, and it is possible to detect magnetism generated from the magnetic source 52 also by this sort of magnetic sensor.

2-2-2. Glove, Supporter, Wristwatch, and Bracelet

Figure 4:
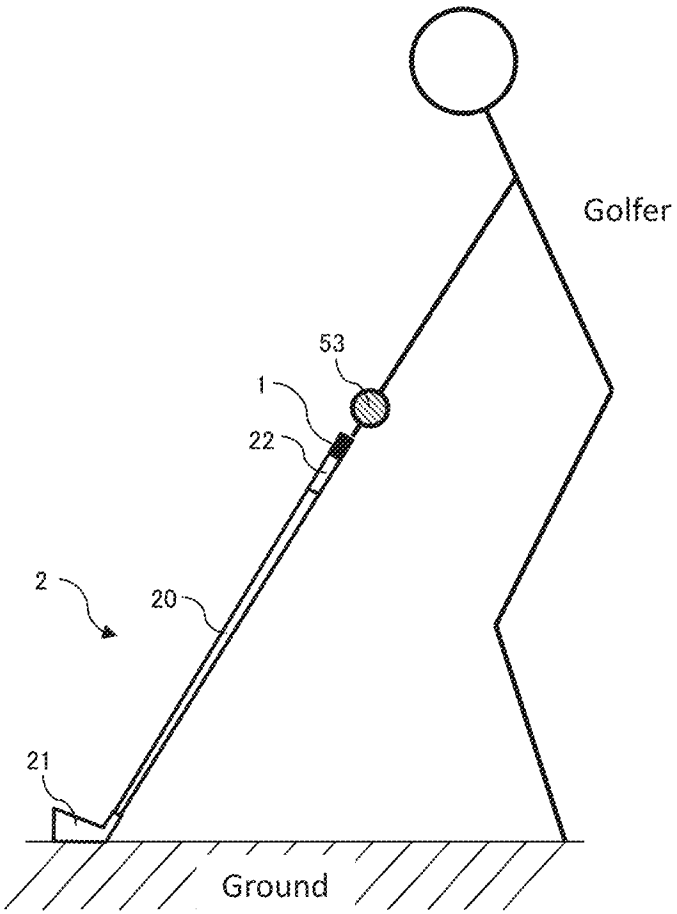
FIG. 4 shows how a golfer holds the golf club with the sensor unit.

The glove 3*d*, the supporter 3*e*, the wristwatch 3*f* and the bracelet 3*g* are items to be worn on the hands, the wrists, the arms, or the like of the golfer during a round. A magnetic source 53 (see FIG. 4) is attached to these accessories 3, at such a position that the play of the golfer wearing them is not hindered.

Like the magnetic source 52, the magnetic source 53 is a magnetism generating source and can be constituted from, for example, a permanent magnet. Magnetism generated from the magnetic source 53 is detected by the geomagnetic sensor 13 when the golfer is holding the golf club 2 by hand. Therefore, based on the magnetism detected by the geomagnetic sensor 13, the control unit 15 of the sensor unit 1 can judge whether or not the golfer is holding the golf club 2 by hand.

2-2-3. Shoes, Clothing, and Ball

The shoes 3*a* and the clothing 3*b* are items worn by the golfer during a round, and the ball 3*c* is struck during the round. The sensor unit 4 is attached to the shoes 3*a* and the clothing 3*b* at a position that does not hinder the play of the golfer wearing them, and where it is possible to detect necessary information. The sensor unit 4 is also attached to the ball 3*c* at a position that does not affect shots, and where it is possible to detect necessary information. For example, in the case of the shoes 3*a*, the sensor unit 4 is fixed to the bottom of the shoes, in the case of the clothing 3*b*, the sensor unit 4 is fixed to a back portion, and in the case of the ball 3*c*, the sensor unit 4 is embedded inside (see FIG. 1).

Figure 5:
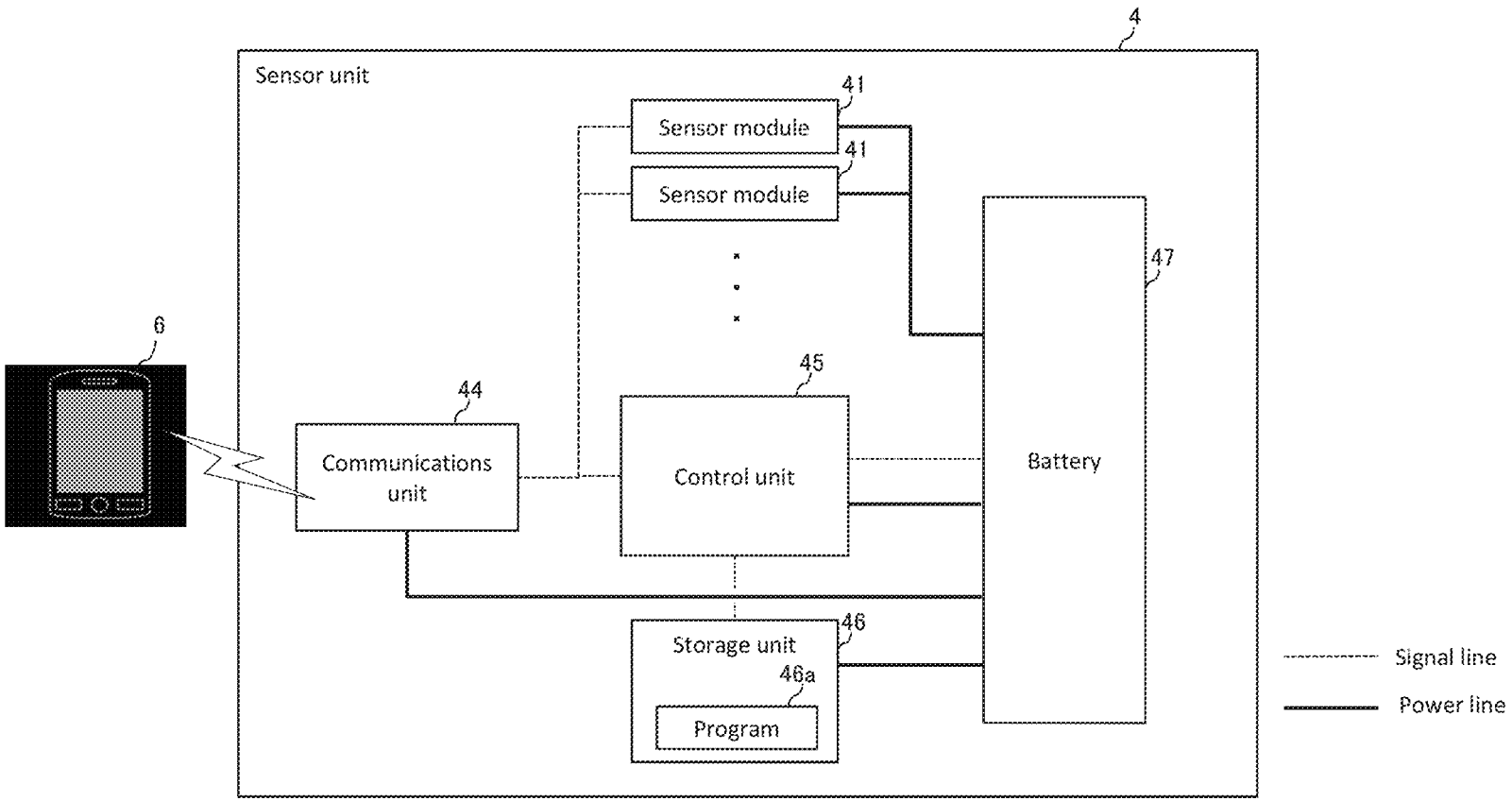
FIG. 5 is a block diagram showing the configuration of a sensor unit attached to an accessory.

As shown in FIG. 5, one or a plurality of sensor modules 41 are mounted in each sensor unit 4. The type of the sensor module 41 is not particularly limited, and can be appropriately selected according to the information to be measured. For example, it is possible to adopt at least one sensor selected from a group consisting of an acceleration sensor, a geomagnetic sensor, an angular velocity sensor, a pressure sensor, a temperature sensor, an inclination sensor, and a position measurement sensor (such as a GPS sensor).

In each sensor unit 4, other than a sensor module 41, there are mounted a communications unit 44, a control unit 45, a storage unit 46, and a battery 47. The communications unit 44 is compliant with the standards of non-contact communications or near-field wireless communications as described above, and enables wireless communications with an external device that is similarly compliant with these standards. The communications unit 44 operates by receiving power supply from the battery 47, and wirelessly transmits the sensor data output from the sensor module 41 to an external device such as the mobile terminal 6.

The control unit 45 is configured with a CPU, a ROM, a RAM, and the like. The control unit 45 operates by receiving power supply from the battery 47, and controls operation of the sensor modules 41, the communications unit 44, the storage unit 46, and the battery 47. The storage unit 46 is configured with a storage device such as a nonvolatile rewritable flash memory or the like, and receives power supply from the battery 47 to store and erase data. A program 46*a* is stored in the storage unit 46, and the CPU of the control unit 45 reads out and executes the program 46*a*, thereby executing operations described later. Note that the program 46*a* may be stored not in the storage unit 46, but in the ROM of the control unit 45, or the program 46*a* may be stored distributed in both the storage unit 46 and the control unit 45. The battery 47 is a power source that supplies power to the sensor modules 41, the communications unit 44, the control unit 45, and the storage unit 46, and the battery 47 is controlled on/off by the control unit 45. The above-mentioned sensor modules 41, the communications unit 44, the control unit 45, the storage unit 46, and the battery 47 are mounted on one or a plurality of substrates.

2-3. Mobile Terminal

Figure 6:
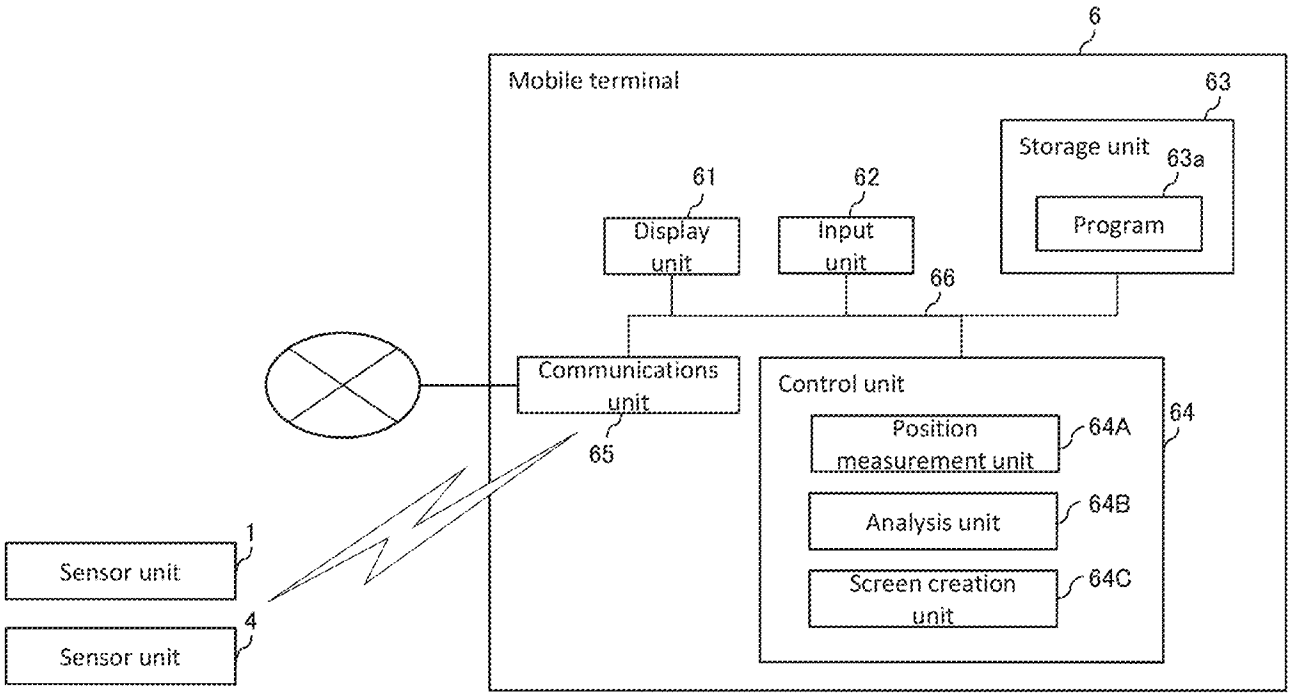
FIG. 6 is a block diagram showing the configuration of a mobile terminal.

FIG. 6 shows the configuration of the mobile terminal 6. The mobile terminal 6 is carried by the golfer, and is carried not only to the golf course, but also to various places such as home or a golf practice range. The mobile terminal 6, as hardware, is a general-purpose computer such as a smart phone, a tablet computer, a laptop computer, or an AR (augmented reality) terminal such as smart glasses, and is configured by installing a program 63*a* in such a computer. The program 63*a* is a program that causes the mobile terminal 6 to execute processing to be described later. Typically, the program 63*a* is distributed from an external device to the mobile terminal 6 through the Internet or a network of non-contact communications or near-field wireless communications as described above.

As shown in FIG. 6, the mobile terminal 6 includes a display unit 61, an input unit 62, a storage unit 63, a control unit 64, and a communications unit 65. These units 61 to 65 are connected to each other through a bus line 66, and are capable of communicating with each other. In the present embodiment, the display unit 61 is configured with a liquid crystal display or the like, and displays necessary information including screens to be described later to the golfer. The input unit 62 is configured with a touch panel or operation buttons, a mouse, a keyboard, and the like, and accepts operation from the golfer to the mobile terminal 6.

The storage unit 63 is configured from a nonvolatile storage device such as a flash memory or a hard disk, and stores the program 63*a*. The control unit 64 is configured from a CPU, a ROM, a RAM, and the like. The control unit 64 reads out and executes the program 63*a* in the storage unit 63 to operate as a position measurement unit 64A, an analysis unit 64B, and a screen creation unit 64C. The position measurement unit 64A communicates with a satellite positioning system such as GPS (Global Positioning System), Michibiki, or GLONASS, and measures the position information of the mobile terminal 6 based on a signal acquired from the same system. Details of the operation of the remaining units 64B and 64C will be described later.

The communications unit 65 functions as a communications interface that connects the mobile terminal 6 to the Internet. Also, the communications unit 65 is compliant with the standards of non-contact communications or near-field wireless communications as described above, and enables wireless communications with an external device (including the sensor units 1 and 4) that is similarly compliant with these standards.

3. Flow of Processing by Golf Measurement System

The processing executed by the golf measurement system 100 includes processing of measuring sensor data through the sensor units 1 and 4 (referred to below as golf measurement processing), and processing of analyzing shots of the golfer based on the measured sensor data (referred to below as shot analysis processing). Below, this processing will be described in order.

3-1. Golf Measurement Processing

Figure 7:
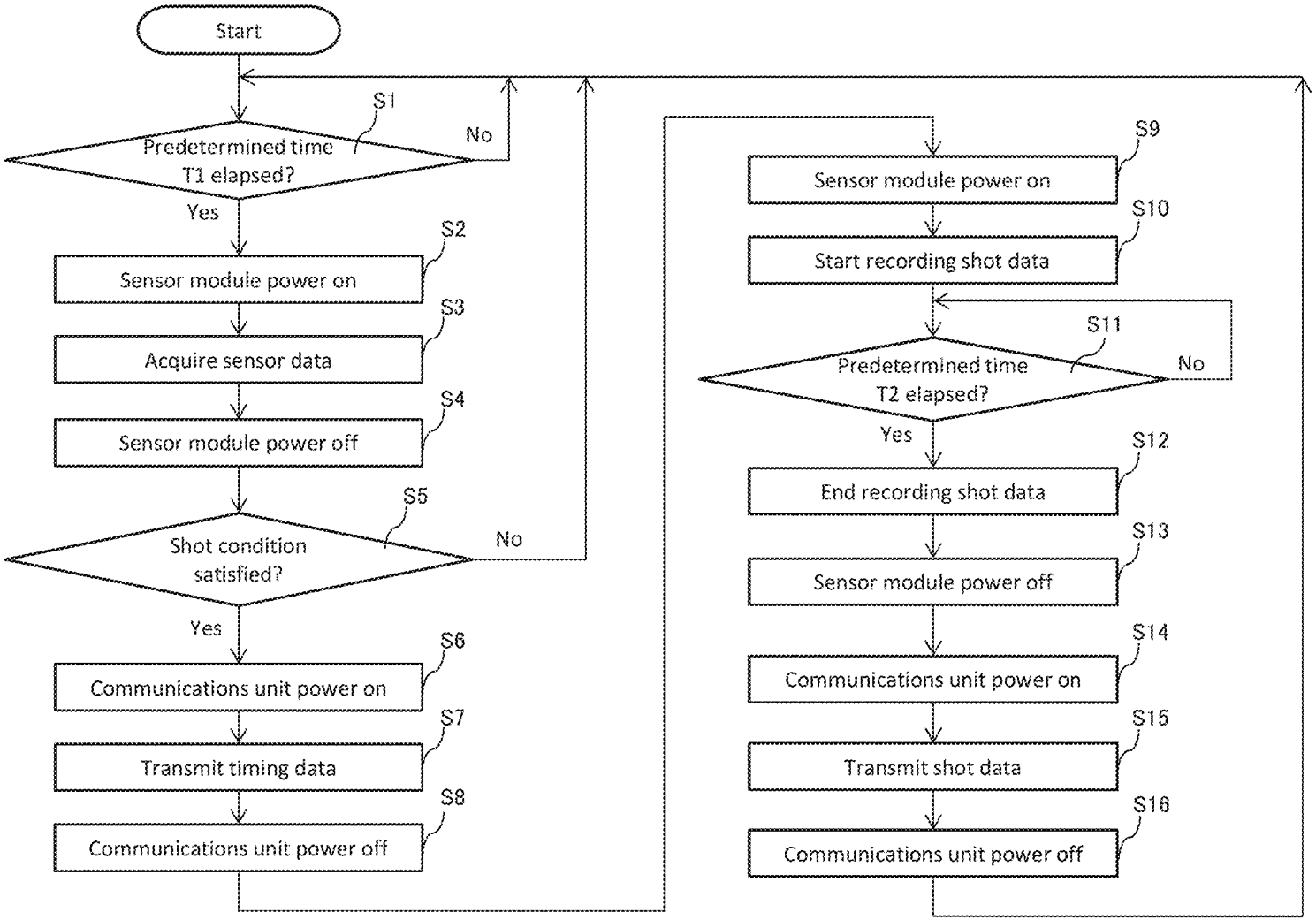
FIG. 7 is a flowchart showing a flow of golf measurement processing.

FIG. 7 is a flowchart showing the flow of golf measurement processing executed by the sensor unit 1. Below, with reference to FIG. 7, the golf measurement processing will be described with reference not only to the processing by the sensor unit 1, but also the processing by the sensor unit 4.

The golf measurement processing shown in FIG. 7 starts when the golfer operates the switch 18 of the sensor unit 1 to turn on the main power supply (the battery 17) of the sensor unit 1. In a case where the golf club 2 with the sensor unit 1 is used during a round at a golf course, the golfer turns on the main power supply at the start of the round, and turns the main power supply off at the end of the round. When the main power supply is turned off, the golf measurement processing shown in FIG. 7 ends.

Figure 8:
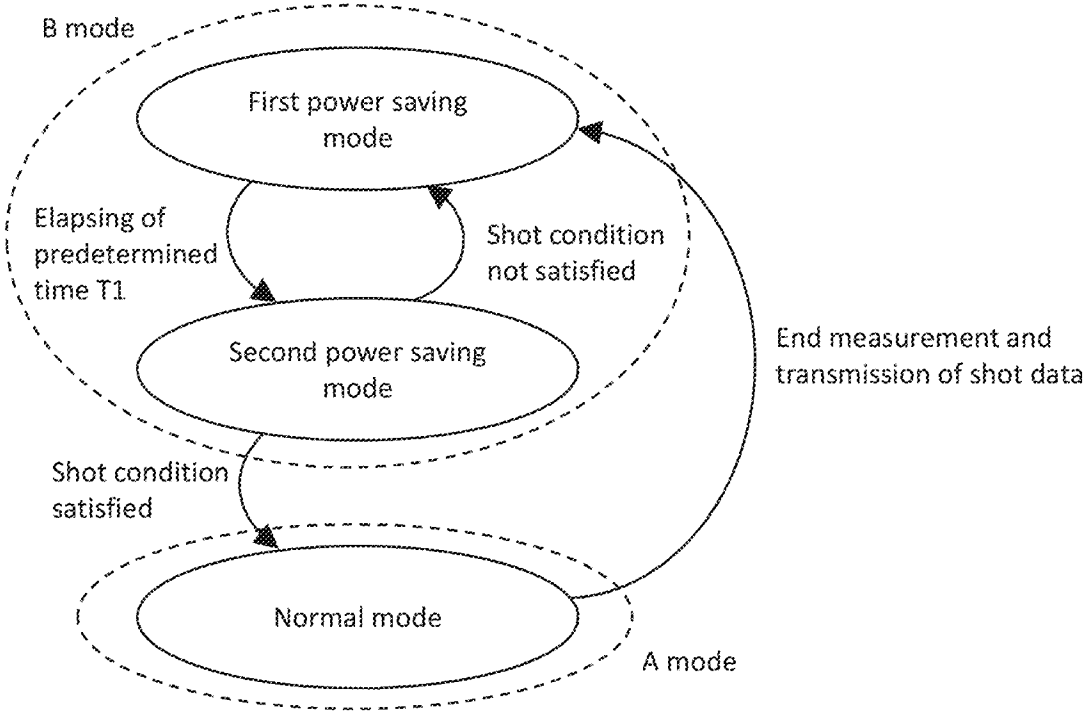
FIG. 8 is a state transition diagram illustrating mode switching in the sensor unit.

When the main power supply is turned on, the control unit 15 first sets an operation state of the sensor unit 1 to a first power saving mode. In the present embodiment, the control unit 15 switches the operation state of the sensor unit 1 between the first power saving mode, a second power saving mode, and a normal mode as shown in FIG. 8. These are modes in which the degree of power consumption of the battery 17 differs. The first and second power saving modes are modes in which the power consumption of the battery 17 is suppressed in comparison to the normal mode, and in the first power saving mode, the power consumption of the battery 17 is suppressed in comparison to the second power saving mode. More specifically, in the first power saving mode, the operation of communications with an external device by the communications unit 14 is restricted, so power consumption by the communications unit 14 is suppressed, and also, the operation of measurement of the sensor data by the sensor modules 11 to 13 and 31 to 33 is limited, so power consumption by the sensor modules 11 to 13 and 31 to 33 is suppressed. In the first power saving mode of the present embodiment, the power supply of the communications unit 14 and the sensor modules 11 to 13 and 31 to 33 is set to off.

As described above, when the golf measurement processing starts, first the operation state of sensor unit 1 is set to the first power saving mode. In the first power saving mode, the control unit 15 waits until a predetermined time T1 has elapsed (step S1), and when the predetermined time T1 has elapsed, the control unit 15 switches to the second power saving mode, and sets the power supply of the sensor modules 11 and 13 and 31 to 33 to on (step S2). Note that in the second power saving mode, the power supply of the communications unit 14 remains set to off. In the second power saving mode, the control unit 15 causes the sensor modules 11 and 13 and 31 to 33 to measure sensor data, and acquires the sensor data (step S3). When measurement of the sensor data is completed, the control unit 15 sets the power supply of the sensor modules 11 and 13, and 31 to 33, to off (step S4), and based on the sensor data acquired in step S3, judges whether or not a shot condition described later is satisfied (Step S5). If the shot condition is not satisfied, the control unit 15 switches the second power saving mode to the first power saving mode and returns to step S1. On the other hand, if the shot condition is satisfied, the control unit 15 switches the second power saving mode to the normal mode and proceeds to step S6.

The shot condition, in the present embodiment, is that the golfer is preparing to shoot using the golf club 2. That is, here, the timing at which the golfer will perform a shot is determined based on the sensor data output from the sensor modules 11 and 13, and 31 to 33.

The shot condition includes the following conditions. In the present embodiment, it is judged that the shot condition is established when any of the following conditions is satisfied. However, it can also be judged that the shot condition is established when all of the following conditions are satisfied, or when a predetermined number of two or more of the following conditions is satisfied. Alternatively, the shot condition can be constructed by appropriately combining the following conditions.

(1) the golf club 2 with the sensor unit 1 is not stored in the caddy bag 5

(2) the golfer is holding the golf club 2 by hand (3) the grip 22 of the golf club 2 is being held (4) the orientation of the longitudinal direction of the shaft 20 of the golf club 2 (which can be defined as the direction from the head 21 toward the grip 22, the same applies below), is within a predetermined range based on a lie angle (5) the orientation of the longitudinal direction of the shaft 20 of the golf club 2 is substantially horizontal or greater Condition (1) means that the caddy bag 5 is not in the vicinity of the geomagnetic sensor 13, and the further away the caddy bag 5 is from this vicinity, the smaller the magnetic strength measured by the geomagnetic sensor 13 becomes. Therefore, regarding condition (1), it is judged to be established when the magnetic strength measured by the geomagnetic sensor 13 is smaller than a predetermined value in step S3, and is judged to not be established if the magnetic strength is not smaller than the predetermined value in step S3. Note that the predetermined value mentioned here can be set in advance based on the magnetic strength detected by the geomagnetic sensor 13 in a state where the golf club 2 is being stored in the caddy bag 5 with the sensor unit 1 pointed toward the bottom side, and the magnetic strength detected by the geomagnetic sensor 13 in a state where a magnetic source does not exist in the vicinity of the geomagnetic sensor 13.

Condition (1) is also judged based on the temperature measured by the temperature sensor 33. That is, condition (1) is judged to not be established when the temperature detected by the temperature sensor 33 is included in an assumed temperature zone in the caddy bag 5, and otherwise is judged to be established.

Condition (2) means that the glove 3*d*, the supporter 3*e*, the wristwatch 3*f* and the bracelet 3*g* are in the vicinity of the geomagnetic sensor 13, and the nearer they are to that vicinity, the stronger the magnetic strength measured by the geomagnetic sensor 13 becomes. Therefore, condition (2) is judged to be established when the magnetic strength acquired by the geomagnetic sensor 13 in step S3 is greater than a predetermined value, and otherwise is judged to not be established. The predetermined value mentioned here can be set in advance based on the magnetic strength detected by the geomagnetic sensor 13 in a state where the golfer wearing the glove 3*d*, the supporter 3*e*, the wristwatch 3*f*, and the bracelet 3*g* is holding the grip 22 by hand, and the magnetic strength detected by the geomagnetic sensor 13 in a state where a magnetic source does not exist in the vicinity of the geomagnetic sensor 13.

Condition (3) is judged to be established when the strength of pressure measured by the pressure sensor 31 in step S3 is greater than a predetermined value, and otherwise is judged to not be established. The predetermined value mentioned here can be set in advance based on the strength of pressure detected by the pressure sensor 31 in a state where the golfer is holding the grip 22 of the golf club 2, and the strength of pressure detected by the pressure sensor 31 in a state where the golfer is not holding the grip 22.

Figure 9B:
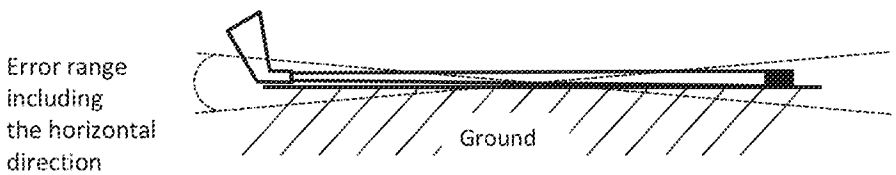
FIG. 9B illustrates another mode transition condition.
Figure 9A:
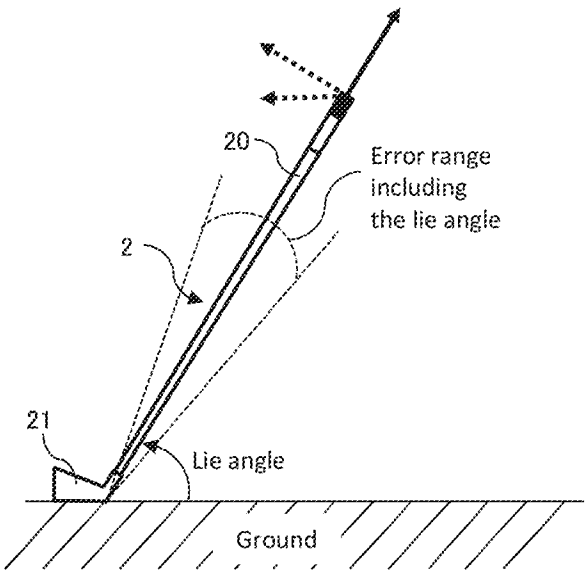
FIG. 9A illustrates a mode transition condition.

Regarding condition (4), the orientation of the longitudinal direction of the shaft 20 is judged based on the direction of the acceleration acquired by the acceleration sensor 11 in step S3, and when judged that this is within a predetermined range based on the lie angle, condition (4) is judged to be established, and otherwise, condition (4) is judged to not be established. That is, when the golfer holds the golf club 2 to perform a shot, the orientation of the longitudinal direction of the shaft 20 falls within an error range including the lie angle (see FIG. 9A). Therefore, by establishing this state, it is judged that the golfer is preparing to perform a shot. Note that the orientation of the longitudinal direction of the shaft 20 can also be judged by an output value from the inclination sensor 32.

Regarding condition (5), the orientation of the longitudinal direction of the shaft 20 is judged based on the acceleration acquired by the acceleration sensor 11 in step S3, and when judged that this is substantially horizontal or more, condition (5) is judged to be established, and otherwise, condition (5) is judged to not be established. That is, the golfer often holds some number of golf clubs 2 before a shot, then approaches the ball 3*c*, and grasps only the necessary golf club 2 and places the other golf clubs 2 on the ground, but at this time, the orientation of the longitudinal direction of the shaft 20 falls within an error range including the horizontal direction (see FIG. 9B). Therefore, by judging that the current state is not this sort of state, it is judged that the golfer is preparing to perform a shot. Note that the orientation of the longitudinal direction of the shaft 20 can also be judged by an output value from the inclination sensor 32.

When the shot condition is established and the mode is switched to the normal mode, the control unit 15 sets the power supply of the communications unit 14 to on (step S6). Next, in step S7, the control unit 15 notifies the external device that the shot condition has been established, that is, the golfer is preparing to perform a shot and the timing for shooting is approaching. Specifically, the control unit 15 generates timing data for giving notification of this timing, and outputs the timing data to the external device through the communications unit 14. In the present embodiment, the timing data is transmitted to the mobile terminal 6.

On the other hand, when the timing data is received, the mobile terminal 6 transmits the timing data to each sensor unit 4 included in the shoes 3*a*, the clothing 3*b*, and the ball 3*c*. On the sensor unit 4 side, the control unit 45 receives this timing data through the communications unit 44, and based on this timing data, causes the sensor module 41 to measure sensor data. Note that the sensor data at this time is sensor data acquired in a period possibly including a shot, including sensor data exactly when the golfer is performing a shot or sensor data just before or after a shot, and is shot data. Thereafter, the control unit 45 transmits the sensor data measured by the sensor module 41 through the communications unit 44, that is, the control unit 45 transmits the shot data to the mobile terminal 6. Note that in the present embodiment, the power supply is set to off for the sensor module 41 except when measuring sensor data based on the timing data.

Returning to operation of the sensor unit 1, the control unit 15, in step S8 following step S7, sets the power supply of the communications unit 14 to off, and further, in following step S9, sets the power supply of the sensor modules 11 to 13 to on. Next, in step S10, the control unit 15 causes the sensor modules 11 to 13 to start measuring the sensor data. This measurement is repeatedly executed during a predetermined time T2. The control unit 15 waits until the predetermined time T2 has elapsed (step S11), and after the predetermined time T2 has elapsed, ends the measurement of the sensor data by the sensor modules 11 to 13 (step S12), and sets the power supply of the sensor modules 11 to 13 to off (step S13). The sensor data collected at this time is sensor data acquired in a period possibly including a shot, including sensor data exactly when the golfer is performing a shot or sensor data just before or after a shot, and is shot data. The shot data is stored in the storage unit 16 or a RAM. Note that a configuration may also be adopted in which, in steps S9 to S12, the power supply of the sensor modules 31 to 33 is also set to on, the sensor modules 31 to 33 are also caused to measure the sensor data, and then the power supply is set to off in step S13.

Next, the control unit 15 sets the power supply of the communications unit 14 to on (step S14), and transmits the shot data to an external device through the communications unit 14 (step S15). In the present embodiment, the shot data is transmitted to the mobile terminal 6. At this time, in the present embodiment, information specifying the type of the golf club 2 (for example, information indicating a model number or a count, hereinafter referred to as club data) that is stored in the storage unit 16 or a ROM is transmitted together with the shot data. Thereafter, the control unit 15 sets the power supply of the communications unit 14 to off (step S16), switches the normal mode to the first power saving mode, and returns to step S1.

As described above, in the normal mode, the shot data is measured by the sensor modules 11 to 13 in small increments at predetermined time intervals during the predetermined time T2. The processing load at this time is larger than the processing load when the sensor data is measured by the sensor modules 11 and 13 and 31 to 33 in step S3 in the second power saving mode. Therefore, power consumption by operation of the sensor modules 11 to 13 and 31 to 33, and the control unit 15 that controls this operation, is greater in the normal mode than in the second power saving mode. Also, in the first power saving mode and the second power saving mode, the communications unit 14 is set to off, so the power consumption by operation of the communications unit 14 and the control unit 15 that controls this operation is also greater in the normal mode than in the first power saving mode and the second power saving mode. Therefore, operation of the control unit 15, the communications unit 14, and the sensor modules 11 to 13 and 31 to 33 is restricted in order of the first power saving mode, the second power saving mode, and the normal mode, and power consumption is also suppressed in the same order. Note that the effect of suppressing power consumption in the present embodiment is greater for suppressing operation of the communications unit 14 than for suppressing operation of the sensor modules 11 to 13 and 31 to 33. Therefore, the difference between the amount of power consumption for the second power saving mode and the normal mode is greater than the difference between the amount of power consumption for the first power saving mode and the second power saving mode.

As described above, in the golf measurement processing according to the present embodiment, the operation state of the sensor unit 1 is automatically switched among a plurality of modes having different degrees of power consumption of the battery 17, according to whether or not predetermined conditions including the shot condition are satisfied. Therefore, it is possible to collect necessary information at a necessary time while conserving the battery 17. The timing when the sensor unit 4 operates is also controlled based on the timing of a shot judged by the sensor unit 1. Therefore, in the sensor unit 4 as well, it is possible to collect necessary information at a necessary time while saving the battery 47.

3-2. Shot Analysis Processing

The shot data collected by the golf measurement processing is transmitted to the mobile terminal 6 together with the club data, as described above. On the mobile terminal 6 side, these are received through the communications unit 65 and stored in the storage unit 63. The analysis unit 64B reads necessary shot data and club data from the storage unit 63 as appropriate, and analyzes shots by the golfer based on this data. For example, the type of the golf club 2 used in each shot, the trajectory of the golf club 2 during a swing in each shot, the speed of the head 21, the striking point of the ball 3*c* on the face of the head 21, the speed of the ball 3*c*, and the like are specified. Also, in the mobile terminal 6, position information is measured at an appropriate time by the position measurement unit 64A. The analysis unit 64B analyzes shot data, specifies the time of impact, and judges the ball striking point of the ball 3*c* in each shot based on position information at the impact time, and this can also be used for shot analysis. When the analysis is completed, the screen creation unit 64C creates a screen that displays the results of that analysis, and displays this screen on the display unit 61 as appropriate. The golfer can see this screen and understand their own play during a round. The results of analysis may be provided to the golfer during the round, or may be provided after the round. Information provided to the golfer during the round includes information used to guide the next actions of the golfer in the round, for example.

4. Modified Examples

Although one embodiment of the present invention has been described above, the present invention is not limited to the above embodiment, and various modifications that do not depart from the gist of the invention can be made. For example, the below changes are possible. Also, the gist of the following modified examples can be combined as appropriate.

4-1

In the above embodiment, the shot analysis processing is performed by the mobile terminal 6, but a configuration may also be adopted in which shot data is transmitted to and accumulated on a server on the Internet, and shot analysis processing is performed on the server. In this case, it is possible for the golfer to acquire the results of analysis by the server from the server through the mobile terminal 6 or an arbitrary computer and display the results on the mobile terminal 6 or the display unit of an arbitrary computer for confirmation. Alternatively, a configuration may be adopted in which the shot data is transmitted to and accumulated on a server on the Internet, and the mobile terminal 6 or an arbitrary computer downloads the shot data as appropriate to perform shot analysis processing. In this case as well, the results of analysis by the shot analysis processing can be displayed on the mobile terminal 6 or the display unit of an arbitrary computer for confirmation. Also, the sensor units 1 and 4 may be configured such that the shot data can be directly transmitted to the server as described above without going through the mobile terminal 6.

4-2

Figure 10:
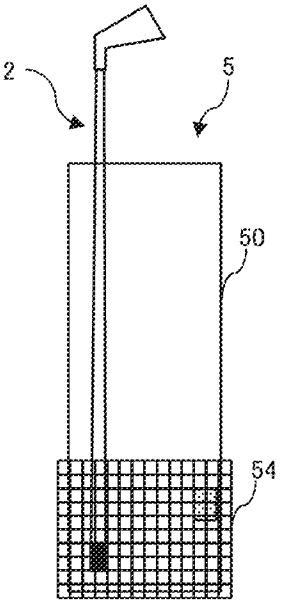
FIG. 10 shows the configuration of a caddy bag according to a modified example.

Instead of the magnetic source 52, a shielding unit 54 that blocks magnetism may be attached to the caddy bag 5 (see FIG. 10). In this case, it is possible to judge that the golf club 2 with the sensor unit 1 is not being stored in the caddy bag 5 when the magnetic strength detected by the geomagnetic sensor 13 of the sensor unit 1 is greater than a predetermined value. The magnetic shielding unit 54 can be realized, for example, as a wire mesh or a metal sheet (including a nonmetallic net or sheet having a metal such as iron powder mixed in) or the like, and the magnetic shielding unit 54 is preferably disposed near the bottom of the caddy bag 5.

4-3

Instead of or in addition to the magnetic source 52, a source 52 of sound, light and/or radio waves may be attached to caddy bag 5. In this case, a sensor module capable of detecting the sound, light and/or radio waves from such a source 52, that is, a sound sensor, a light sensor and/or a radio wave sensor is mounted in the sensor unit 1. In this case, the control unit 15 can judge whether or not the golf club 2 with the sensor unit 1 is stored in the caddy bag 5 according to the strength of the signal detected by the sound sensor, the light sensor, and/or the radio wave sensor. Note that the sound sensor is a sensor module that measures a sound in a specific frequency band (which may be a sound in a region inaudible to humans such as an ultrasonic wave, or a sound in an audible region). The light sensor is a sensor module that measures light in a specific wavelength region (which may be light in a region invisible to humans such as infrared light, or light in a visible region). The radio wave sensor is a sensor module that measures radio waves of a specific frequency band.

When a light sensor is mounted in the sensor unit 1, a shielding unit 54 that blocks light may be attached to the caddy bag 5 instead of the light source 52. For example, the shielding unit 54 may be a part of the bag body 50 of the caddy bag 5, or may be realized as a light blocking (light filter) sheet additionally attached to the bag body 50. Also, in this case, the control unit 15 can judge whether or not the golf club 2 with the sensor unit 1 is stored in the caddy bag 5 according to the intensity of light detected by the light sensor. That is, when the light sensor is in the caddy bag 5, sunlight is blocked by the caddy bag 5. Therefore, when the surrounding environment is judged by the light sensor to be dark, it is possible to judge that the golf club 2 is inside the caddy bag 5, and when the surrounding environment is judged by the light sensor to be bright, it is possible to judge that the golf club 2 is outside the caddy bag 5.

Also, when a sound sensor, a light sensor and/or a radio wave sensor is mounted in the sensor unit 1, instead of or in addition to the magnetic source 53, a source 53 of sound, light and/or radio waves may be attached to the glove 3*d*, the supporter 3*e*, the wristwatch 3*f*, and the bracelet 3*g*.

4-4

Examples of the accessory 3 to which the sensor unit 4 is attached, and the accessory 3 to which the sources 52 and 53 of magnetism, sound, light, radio waves, or the like and the shielding unit 54 are attached, are not limited to those described above. A similar mechanism can be attached to various accessories carried by the golfer.

4-5

Regarding the sensor unit 4 as well, similar to the sensor unit 1, operation of the communications unit 44 can be restricted. For example, in the sensor unit 4, a configuration may be adopted in which a power saving mode in which the communications unit 44 is set to off is usually set, the mode is switched to the normal mode at predetermined time intervals, the presence or absence of timing data from the mobile terminal 6 is monitored through the communications unit 44, and afterward the mode is returned to the power saving mode. With this configuration, in the sensor unit 4, the battery 47 can be further conserved.

4-6

The operation state mode of the sensor unit 1 described above is given as an example. For example, by decreasing the number of clocks of the CPU, it is possible to realize a mode (a mode B) that limits operation of the control unit 15 and suppresses power consumption by the control unit 15.

4-7

Figure 11:
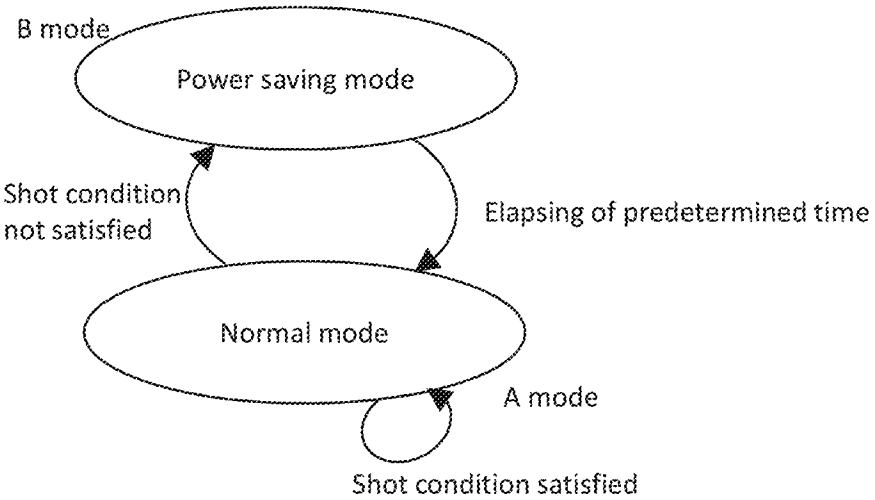
FIG. 11 is a state transition diagram illustrating mode switching in a sensor unit according to a modified example.
Figure 12:
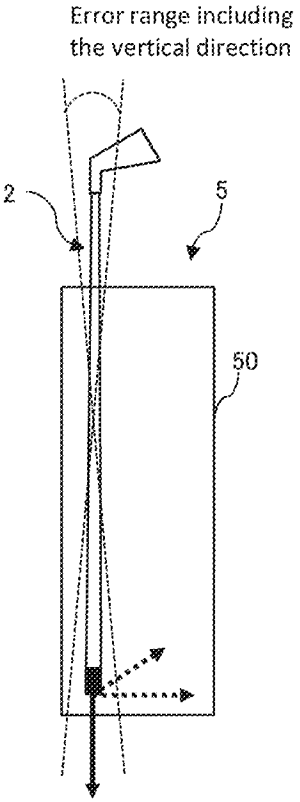
FIG. 12 illustrates a mode transition condition according to a modified example.

In the above embodiment, when the shot condition is established, operation of the sensor unit 1 is promoted, and operation shifts to a mode with a higher power consumption. However, a configuration may also be adopted in which, conversely, as shown in FIG. 11, when the shot condition is not established (in other words, a non-shot condition in which the golfer is not preparing to shoot), operation of the sensor unit 1 is suppressed, and control is performed so as to shift to a mode that saves more power. For example, in the above embodiment, when judged that the golf club 2 is not stored in the caddy bag 5, the mode is shifted to a mode in which there is greater power consumption in the sensor unit 1. However, a configuration may be adopted in which, conversely, when judged that the golf club 2 is stored in the caddy bag 5 (satisfying the non-shot condition), and the caddy bag 5 is in the vicinity of the sensor unit 1, control is performed such that the sensor unit 1 shifts to a mode that saves more power. Also, a configuration may be adopted in which, as shown in FIG. 12, when the orientation of the longitudinal direction of the shaft 20 falls within an error range including the vertical direction (although preferably limited to the depression angle), it is judged that the golf club 2 is stored in the caddy bag 5 (satisfying the non-shot condition), and control is performed to shift to a mode that saves more power.

Instead of or in addition to this, a configuration may also be adopted in which when an accessory 3 such as the glove 3*d*, the supporter 3*e*, the wristwatch 3*f*, and the bracelet 3*g* or the like is judged to not be in the vicinity of the sensor unit 1, it is judged that the golfer is not preparing to shoot (satisfying the non-shot condition), and control is performed to shift to a mode that saves more power.

Instead of or in addition to this, a configuration may also be adopted in which when judged that the grip 22 is not being gripped, it is judged that the golfer is not preparing to shoot (satisfying the non-shot condition), and control is performed to shift to a mode that saves more power.

Instead of or in addition to this, a configuration may also be adopted in which when the orientation of the longitudinal direction of the shaft 20 is not within a predetermined range, it is judged that the golfer is not preparing to shoot (satisfying the non-shot condition), and control is performed to shift to a mode that saves more power.

4-8

Above, the timing data from the sensor unit 1 is transmitted to the sensor unit 4 through the mobile terminal 6, but the sensor units 1 and 4 may also perform direct communications without going through the mobile terminal 6.

4-9

By storing the program 16*a* in a ROM, it is possible to omit the storage unit 16 from the sensor unit 1. Note that it is sufficient that the shot data transmitted to the mobile terminal 6 through the communications unit 14 is temporarily stored in a RAM, and it is not necessary to store this shot data in the storage unit 16. Likewise, the storage unit 46 can be omitted from the sensor unit 4.

4-10

Figure 13:
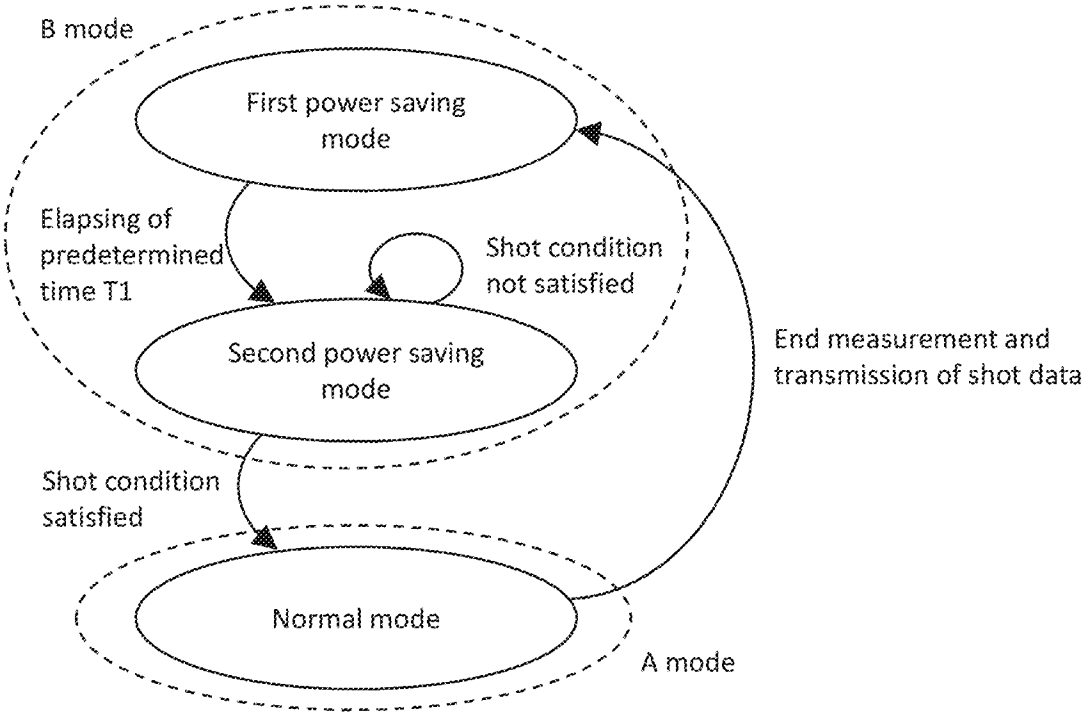
FIG. 13 is a state transition diagram illustrating mode switching in a sensor unit according to another modified example.

In the above embodiment, when judged that the shot condition is not established in step S5 (the non-shot condition is established), the mode returns from the second power saving mode to the first power saving mode, and processing returns to step S1. However, a configuration may also be adopted in which, as shown in FIG. 13, when judged that the shot condition is not established in step S5, processing returns to step S2 and the second power saving mode is maintained.

LIST OF REFERENCE NUMERALS

1 Sensor unit (first sensor unit)
100 Golf measurement system
11 Acceleration sensor (sensor module)
12 Angular velocity sensor (sensor module)
13 Geomagnetic sensor (sensor module)
14 Communications unit
15 Control unit
17 Battery
2 Golf club
22 Grip
3 Accessory
3*a* Shoes
3*b* Clothing
3*c* Ball
3*d* Glove
3*e* Supporter
3*f* Wristwatch
3*g* Bracelet
31 Pressure sensor (sensor module)
32 Inclination sensor (sensor module)
33 Temperature sensor (sensor module)
4 Sensor unit (second sensor unit)
5 Caddy bag (accessory)
51 Charger
52 Source
53 Source
54 Shielding unit
6 Mobile terminal (external device)

What is claimed is:

1. A golf measurement system, comprising:

a sensitive golf club including:

a golf club; and a sensor unit attached to the golf club;

the sensor unit including:

a battery;

a sensor module configured to receive power supply from the battery, and measure sensor data indicating a state of the golf club;

a communications unit configured to receive power supply from the battery, and wirelessly transmit the sensor data to an external device; and a control unit configured to receive power supply from the battery, and control operation of the sensor module and the communications unit;

the sensor unit having an A mode, and a B mode in which operation of the communications unit is suppressed compared to the A mode;

the control unit is configured to judge whether or not the golf club is prepared for a shot based on the sensor data, and execute processing of at least one of below (1) and (2):

(1) being processing where, in the B mode, when judged that the golf club is prepared for a shot, the sensor unit is switched to the A mode, and when judged that the golf club is not prepared for a shot, the sensor unit is not switched to the A mode; and (2) being processing where, in the A mode, when judged that the golf club is not prepared for a shot, the sensor unit is switched to the B mode, and when judged that the golf club is prepared for a shot, the sensor unit is not switched to the B mode; and an accessory adapted to be carried by a golfer, the accessory including a source that generates an element detectable by the sensitive golf club when the accessory is in the vicinity of the sensitive golf club.

2. The golf measurement system according to claim 1, wherein the B mode is a mode where, in addition to operation of the communications unit, operation of the sensor module is suppressed compared to the A mode.

3. The golf measurement system according to claim 1, wherein the sensor module includes at least one of an acceleration sensor and an inclination sensor, and the control unit, in order to judge whether or not the golf club is prepared for a shot, is configured to at least judge whether or not an orientation of the golf club is within a predetermined range.

4. The golf measurement system according to claim 1, wherein the sensor module includes a pressure sensor attached to a grip included in the golf club, the pressure sensor measuring sensor data indicating whether or not the grip is being gripped, and the control unit, in order to judge whether or not the golf club is prepared for a shot, is configured to at least judge whether or not the grip is being gripped.

5. The golf measurement system according to claim 1, wherein the sensor module includes at least one sensor selected from a group consisting of an acceleration sensor, a magnetic sensor, an angular velocity sensor, a sound sensor, a light sensor, a radio wave sensor, a pressure sensor, a temperature sensor, and an inclination sensor.

6. The golf measurement system according to claim 1, wherein the control unit, in order to judge whether or not the golf club is prepared for a shot, is configured to at least judge whether or not the accessory is in the vicinity of the sensor unit.

7. The golf measurement system according to claim 6, wherein the accessory includes a caddy bag adapted to store the sensitive golf club, and the control unit, in order to at least judge whether or not the golf club is stored in the caddy bag, is configured to judge whether or not the caddy bag is in the vicinity of the sensor unit.

8. The golf measurement system according to claim 7, wherein the caddy bag has a source of at least one element selected from a group consisting of magnetism, sound, light, and radio waves, or a shielding unit of the element, and the sensor module includes a sensor configured to detect the element.

9. The golf measurement system according to claim 1, wherein the element is selected from a group consisting of magnetism, sound, light, and radio waves, and the sensor module includes a sensor configured to detect the element.

10. The golf measurement system according to claim 1, wherein the accessory is adapted to be worn on at least one part among the hands, the wrists, and the arms of the golfer.

11. A golf measurement system, comprising:

a sensitive golf club including:

a golf club; and a sensor unit attached to the golf club;

the sensor unit including:

a battery;

a sensor module configured to receive power supply from the battery, and measure sensor data indicating a state of the golf club; and a control unit configured to receive power supply from the battery, and control operation of the sensor module;

the sensor unit having an A mode, and a B mode in which operation of the sensor module is suppressed compared to the A mode;

the control unit is configured to judge whether or not the golf club is prepared for a shot based on the sensor data, and execute processing of at least one of below (1) and (2):

(1) being processing where, in the B mode, when judged that the golf club is prepared for a shot, the sensor unit is switched to the A mode, and when judged that the golf club is not prepared for a shot, the sensor unit is not switched to the A mode; and (2) being processing where, in the A mode, when judged that the golf club is not prepared for a shot, the sensor unit is switched to the B mode, and when judged that the golf club is prepared for a shot, the sensor unit is not switched to the B mode; and an accessory adapted to be carried by a golfer, the accessory including a source that generates an element detectable by the sensitive golf club when the accessory is in the vicinity of the sensitive golf club.

12. The golf measurement system according to claim 11, wherein the sensor module includes at least one of an acceleration sensor and an inclination sensor, and the control unit, in order to judge whether or not the golf club is prepared for a shot, is configured to at least judge whether or not an orientation of the golf club is within a predetermined range.

13. The golf measurement system according to claim 11, wherein the sensor module includes a pressure sensor attached to a grip included in the golf club, the pressure sensor measuring sensor data indicating whether or not the grip is being gripped, and the control unit, in order to judge whether or not the golf club is prepared for a shot, is configured to at least judge whether or not the grip is being gripped.

14. The golf measurement system according to claim 11, wherein the sensor module includes at least one sensor selected from a group consisting of an acceleration sensor, a magnetic sensor, an angular velocity sensor, a sound sensor, a light sensor, a radio wave sensor, a pressure sensor, a temperature sensor, and an inclination sensor.

15. The golf measurement system according to claim 11, wherein the control unit, in order to judge whether or not the golf club is prepared for a shot, is configured to at least judge whether or not the accessory is in the vicinity of the sensor unit.

16. The golf measurement system according to claim 15, wherein the accessory includes a caddy bag adapted to store the sensitive golf club, and the control unit, in order to at least judge whether or not the golf club is stored in the caddy bag, is configured to judge whether or not the caddy bag is in the vicinity of the sensor unit.

17. The golf measurement system according to claim 16, wherein the caddy bag has a source of at least one element selected from a group consisting of magnetism, sound, light, and radio waves, or a shielding unit of the element, and the sensor module includes a sensor configured to detect the element.

18. The golf measurement system according to claim 11, wherein the element is selected from a group consisting of magnetism, sound, light, and radio waves, and the sensor module includes a sensor configured to detect the element.

19. The golf measurement system according to claim 11, wherein the accessory is adapted to be worn on at least one part among the hands, the wrists, and the arms of the golfer.

20. A sensitive golf club, comprising:

a golf club; and a sensor unit attached to the golf club;

the sensor unit including:

a battery;

a sensor module configured to receive power supply from the battery, and measure sensor data indicating a state of the golf club;

a communications unit configured to receive power supply from the battery, and wirelessly transmit the sensor data to an external device; and a control unit configured to receive power supply from the battery, and control operation of the sensor module and the communications unit;

the sensor unit having an A mode, and a B mode in which operation of the communications unit is suppressed compared to the A mode;

the control unit is configured to judge whether or not the golf club is prepared for a shot based on the sensor data, and execute processing of at least one of below (1) and (2):

(1) being processing where, in the B mode, when judged that the golf club is prepared for a shot, the sensor unit is switched to the A mode, and when judged that the golf club is not prepared for a shot, the sensor unit is not switched to the A mode; and (2) being processing where, in the A mode, when judged that the golf club is not prepared for a shot, the sensor unit is switched to the B mode, and when judged that the golf club is prepared for a shot, the sensor unit is not switched to the B mode, the B mode includes a first power saving mode and a second power saving mode, in the first power saving mode, power consumption of the battery is suppressed in comparison to the second power saving mode, when a predetermined time has elapsed in the first power saving mode, the sensor unit is switched to the second power saving mode, when judged that the golf club is prepared for a shot in the second power saving mode, the sensor unit is switched to the A mode, and when judged that the golf club is not prepared for a shot in the second power saving mode, the sensor unit is not switched to the A mode, and when judged that the golf club is not prepared for a shot in the A mode, the sensor unit is switched to the first power saving mode, and when judged that the golf club is prepared for a shot in the A mode, the sensor unit is not switched to the first power saving mode.

* * * * *